US010088857B1

(12) United States Patent
Zhang et al.

(10) Patent No.: US 10,088,857 B1
(45) Date of Patent: Oct. 2, 2018

(54) HIGHLY GRANULAR VOLTAGE REGULATOR

(71) Applicant: Apple Inc., Cupertino, CA (US)

(72) Inventors: Weibiao Zhang, Plano, TX (US); Daniel J. Fritchman, San Francisco, CA (US); Jafar Savoj, Sunnyvale, CA (US); Venkatesh B Acharya, Austin, TX (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/715,381

(22) Filed: Sep. 26, 2017

(51) Int. Cl.
*G05F 1/563* (2006.01)
*G05F 1/575* (2006.01)

(52) U.S. Cl.
CPC ..... *G05F 1/563* (2013.01); *G05F 1/575* (2013.01)

(58) Field of Classification Search
CPC ..... G05F 1/563; G05F 1/575
See application file for complete search history.

(56) References Cited

U.S. PATENT DOCUMENTS 6,268,817 B1 * 7/2001 Min ..... H03M 1/682 341/145
7,362,191 B2 4/2008 Chen
8,648,580 B2 2/2014 Wong
9,081,404 B2 7/2015 Jackson
9,100,757 B2 8/2015 Johnson
9,494,960 B2 11/2016 Weerakoon
9,696,350 B2 7/2017 Burton
2005/0001605 A1 * 1/2005 Marinca ..... G05F 3/30 323/314
2006/0050036 A1 * 3/2006 Miura ..... G09G 3/3696 345/89
2015/0263618 A1 * 9/2015 Chern ..... G05F 1/575 323/271
2016/0282891 A1 * 9/2016 Kikuta ..... G05F 1/625
2017/0199089 A1 7/2017 Fritchman

* cited by examiner

*Primary Examiner* — Jue Zhang
(74) *Attorney, Agent, or Firm* — Meyertons, Hood, Kivlin, Kowert & Goetzel, P.C.; Erik A. Heter

(57) ABSTRACT

A highly granular voltage regulator is disclosed. The voltage regulator circuit includes first and second current mirror circuits coupled to first and second control circuits, respectively. The voltage regulator circuit further includes an amplifier having an inverting input and a non-inverting input. The first current mirror circuit is coupled to the non-inverting input, whereas the second current mirror circuit is coupled to the inverting input. The first control circuit is operable to control a current provided by the first current mirror circuit, while the second control circuit is operable to control a current provided by the second current mirror circuit.

18 Claims, 4 Drawing Sheets

HIGHLY GRANULAR VOLTAGE REGULATOR

BACKGROUND

Technical Field

This disclosure is directed to electronic circuits, and more particularly, to voltage regulator circuits.

Description of the Related Art

Voltage regulators are commonly used in a wide variety of circuits in order to provide a desired voltage to particular circuits. To this end, a wide variety of voltage regulator circuits are available to suit various applications. Linear voltage regulators are used in a number of different applications in which the available supply voltages exceed an appropriate value for the circuitry to be powered. Accordingly, linear voltage regulators may output a voltage that is less than the received supply voltage.

One type of linear voltage regulator is the low dropout (LDO) regulator. An LDO voltage regulator may operate to provide an output voltage that is very close to the received supply voltage. Furthermore, LDO voltage regulators may be relatively simple in design in comparison with some other types of voltage regulators, such as buck or boost converters which require switching among multiple voltage regulator phases.

SUMMARY

A highly granular voltage regulator is disclosed. In one embodiment, a voltage regulator circuit includes first and second current mirror circuits coupled to first and second control circuits, respectively. The voltage regulator circuit further includes an amplifier having an inverting input and a non-inverting input. The first current mirror circuit is coupled to the non-inverting input, whereas the second current mirror circuit is coupled to the inverting input. The first control circuit is operable to control a current provided by the first current mirror circuit, while the second control circuit is operable to control a current provided by the second current mirror circuit.

In one embodiment, adjustment by the first control circuit results in an adjustment to an offset voltage provided to the non-inverting input of the amplifier. Adjustment by the second control circuit may provide an adjustment to the gain of the regulator. Some embodiments may include a third control circuit and a variable resistor coupled between the non-inverting input and a reference (e.g., ground) node, a fourth control circuit, and a variable resistor coupled between the output of the amplifier and the inverting input.

BRIEF DESCRIPTION OF THE DRAWINGS

The following detailed description makes reference to the accompanying drawings, which are now briefly described.

Figure 1:
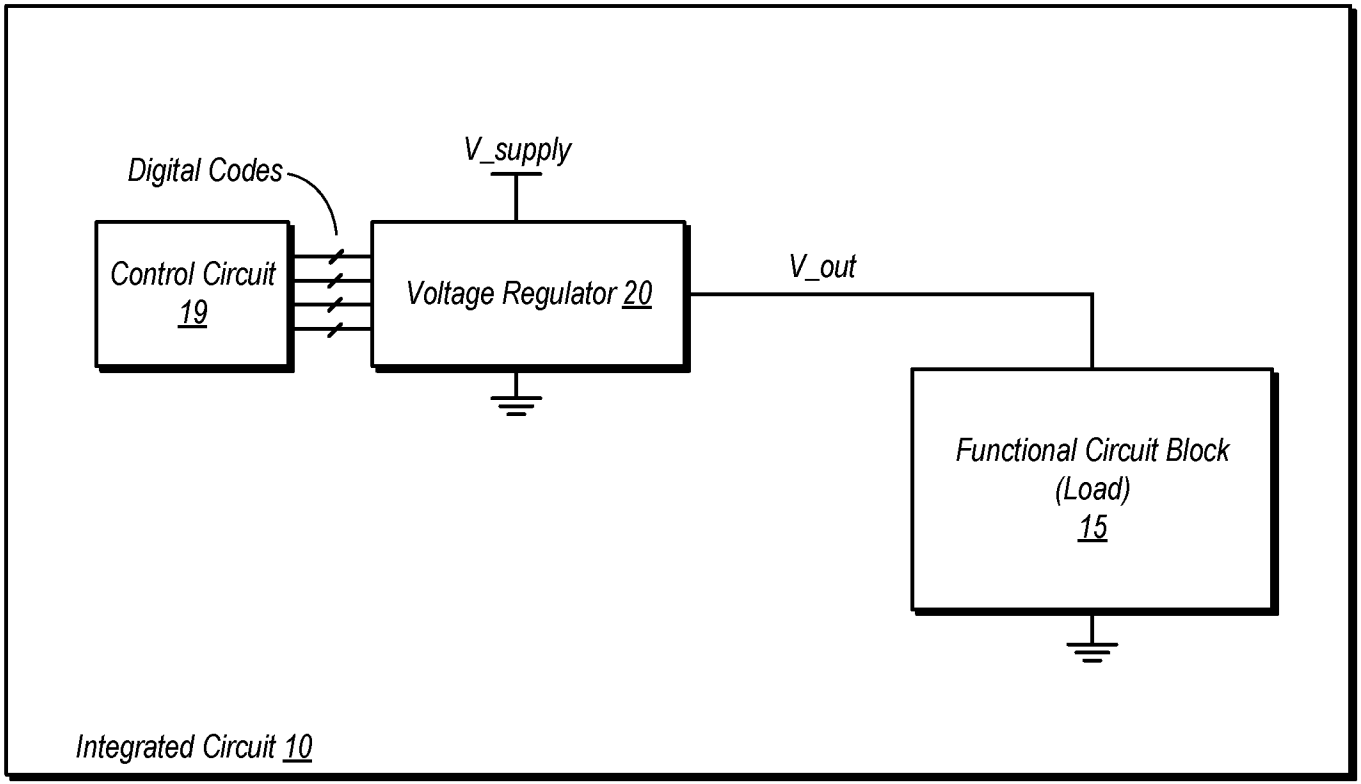
FIG. 1 is a block diagram of one embodiment of an integrated circuit (IC) having a voltage regulator implemented thereon.

Although the embodiments disclosed herein are susceptible to various modifications and alternative forms, specific embodiments are shown by way of example in the drawings and are described herein in detail. It should be understood, however, that drawings and detailed description thereto are not intended to limit the scope of the claims to the particular forms disclosed. On the contrary, this application is intended to cover all modifications, equivalents and alternatives falling within the spirit and scope of the disclosure of the present application as defined by the appended claims.

This disclosure includes references to "one embodiment," "a particular embodiment," "some embodiments," "various embodiments," or "an embodiment." The appearances of the phrases "in one embodiment," "in a particular embodiment," "in some embodiments," "in various embodiments," or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently being operated. A "credit distribution circuit configured to distribute credits to a plurality of processor cores" is intended to cover, for example, an integrated circuit that has circuitry that performs this function during operation, even if the integrated circuit in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function, although it may be "configurable to" perform that function after programming.

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

As used herein, the phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

As used herein, the terms "first," "second," etc. are used as labels for nouns that they precede, and do not imply any type of ordering (e.g., spatial, temporal, logical, etc.), unless stated otherwise. For example, in a register file having eight registers, the terms "first register" and "second register" can be used to refer to any two of the eight registers, and not, for example, just logical registers 0 and 1.

When used in the claims, the term "or" is used as an inclusive or and not as an exclusive or. For example, the phrase "at least one of x, y, or z" means any one of x, y, and z, as well as any combination thereof.

In the following description, numerous specific details are set forth to provide a thorough understanding of the disclosed embodiments. One having ordinary skill in the art, however, should recognize that aspects of disclosed embodiments might be practiced without these specific details. In some instances, well-known circuits, structures, signals, computer program instruction, and techniques have not been shown in detail to avoid obscuring the disclosed embodiments.

DETAILED DESCRIPTION OF EMBODIMENTS

Turning now to FIG. 1, a block diagram of one embodiment of an integrated circuit (IC) is shown. IC 10 is shown here for illustrative purposes, and is not intended to be limiting. On the contrary, a wide variety of ICs that include various features set forth in this disclosure are possible and contemplated.

In the embodiment shown, IC 10 includes a functional circuit block 15, which may perform various functions carried out by the IC. Functional circuit block 15 may be any type of circuitry, analog, digital, or mixed. Additional functional circuit blocks may be present, although only one is shown here for the sake of simplicity. Functional circuit block 15 may interface with any additional functional circuit blocks that may be present. Interfaces between functional circuit block 15 and the circuitry external to IC 10 may also be present.

Functional circuit block 15 in the embodiment shown is a load for voltage regulator 20. In particular, the supply voltage provided to functional circuit block 15 may be V_out that is provided by the voltage regulator. In one embodiment, voltage regulator 20 may be a low dropout (LDO) voltage regulator, and may include a number of integrated digital-to-analog converters (DACs). These DACs may be used to control various operational parameters of voltage regulator 20, including gain and offset voltage, among others. Each of these DACs may include a control circuit that receives a digital code and which causes corresponding actions to be carried out in the analog domain.

Control of voltage regulator 20 may be performed, at least in part, by control circuit 19. In the embodiment shown, control circuit 19 is coupled to convey a number of digital codes to voltage regulator 20. These digital codes may be received by the various integrated DACs. In turn, the integrated DACs may convert these digital codes into corresponding analog signals that are provided to various circuits to control the parameters of operation of voltage regulator 20. The digital codes may each include a number of bits, and these numbers may be different from one to another (although this is not a requirement for all embodiments).

In some embodiments, control circuit 19 may be part of a power management circuit that provides various power management functions. Among these functions may be the adjustment of the output voltage, V_out, provided by voltage regulator 20 (e.g., for various performance states, and so on).

Power may be provided to voltage regulator 20 from the voltage rail V_supply. This may be a source of power that is external to IC 10, although embodiments in which voltage regulator 20 receives power from an on-chip source are also possible and contemplated.

Figure 2:
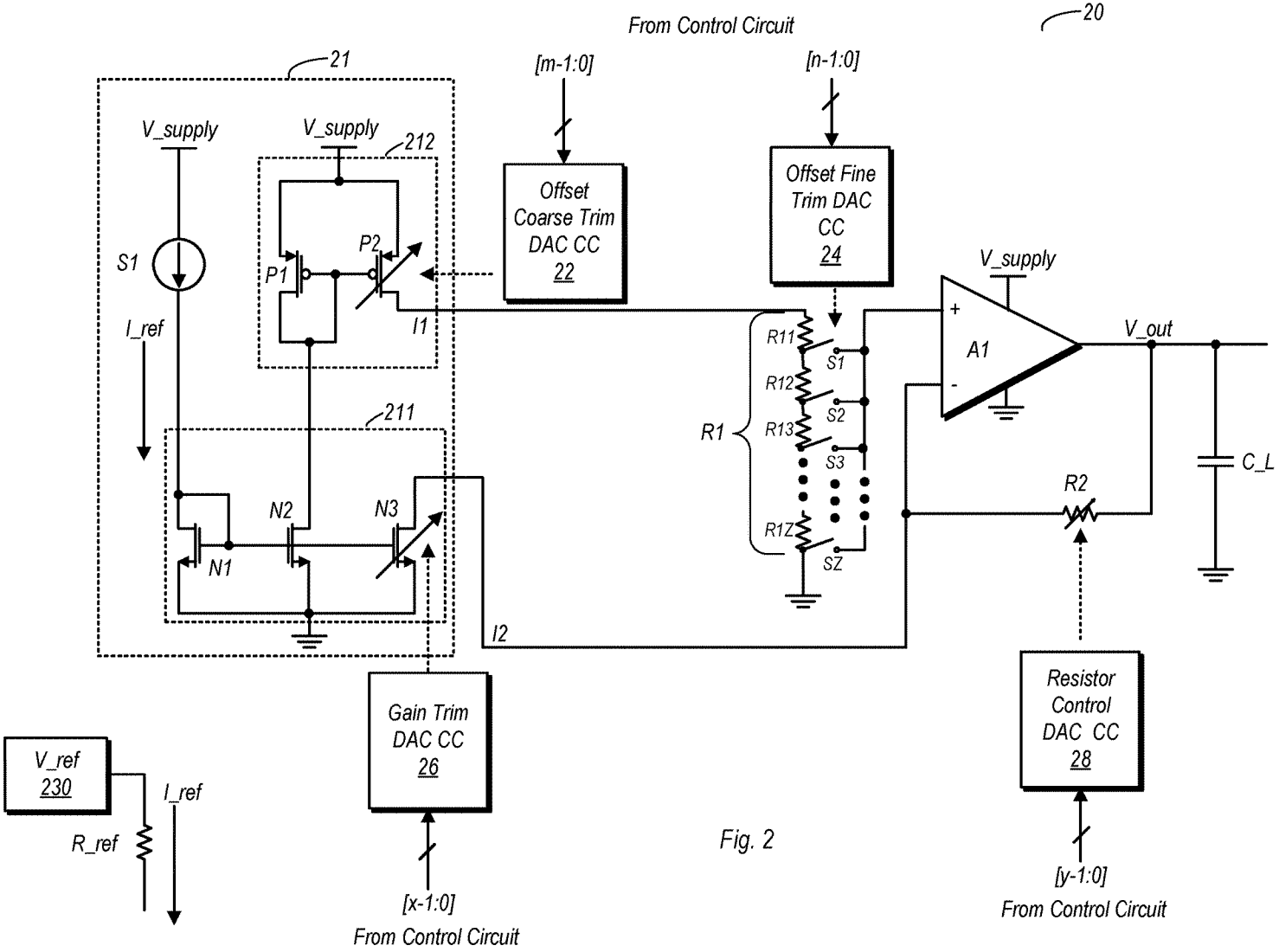
FIG. 2 is a schematic diagram of one embodiment of a voltage regulator circuit.

Turning now to FIG. 2, a schematic diagram of one embodiment of a voltage regulator is shown. In the embodiment shown, voltage regulator 20 includes a current mirror unit 21, a number of DACs (which include respective control circuits and corresponding circuitry coupled thereto), and an amplifier A1 that is configured to generate and provide the output voltage, V_out. As noted above, voltage regulator 20 is an LDO voltage regulator.

Current mirror unit 21 includes two current mirror circuits, current mirror 211 and current mirror 212, along with a reference current source S1. Current mirror 211 is coupled to receive the reference current, I_ref, from the reference current source. In particular, the reference current is received by the diode coupled NMOS transistor N1. The reference current is mirrored through transistors N2 and N3 in the embodiment shown, with the output current, I2, passing through transistor N3. The source terminals of N1, N2, and N3 are each coupled to a reference (e.g., ground) node.

Current mirror 212 is implemented using diode-coupled PMOS transistor P1 along with transistor P2. The gate and drain terminals of P1 are coupled to the drain terminal of N2. Thus, the current through N2 is mirrored through transistor P2. The source terminals of transistors P1 and P2 are coupled to receive the supply voltage, V_supply. Thus, the reference current I_ref is effectively mirrored through P2 in the arrangement shown, with the current through P2 designated here as I1.

The reference current that is mirrored through N2, N3, and the transistors of current mirror 212 in the illustrated embodiment is equivalent to (and may be produced by) a reference voltage, V_ref, divided by a reference resistance, R_ref. In various embodiment, a reference voltage generation circuit is provided, along with a reference resistor in order to generate the reference current.

Amplifier A1 in the embodiment shown is an operational amplifier that includes inverting and non-inverting input. The non-inverting input of A1 is coupled to P2, and thus to current mirror 212. Additionally, variable resistor R1 is coupled between the non-inverting input and ground in the embodiment shown. The input to the non-inverting input in this embodiment is an offset voltage generated by the current passing through resistor R1. More particularly, the offset voltage V_os may be expressed as the following: V_os=I1*R1. The inverting input of A1 is coupled to N3, and thus to current mirror 211. Additionally, variable feedback resistor R2 is between the output of A1 and the inverting input. A capacitor C L coupled to the output of A1 is representative of the capacitance provided by the load (e.g., functional circuit block 15 of FIG. 1).

In this embodiment, setting of the offset voltage is accomplished via DACs associated with DAC control circuits 22 and 24. DAC control circuit 22 in this embodiment, in conjunction with P2, provides coarse control of the offset voltage by adjusting the current through P2, and thus the current output from current mirror 212, I1. Although represented in the drawing as a single transistor, P2 may actually be a group of current sources (e.g., implemented as transistors) controlled by the logic signals [m−1:0] provided to DAC control circuit 22. For example, consider an embodiment in which m=2, and thus P2 can be a group of four current sources with currents of (to use exemplary values) 4 μA, 6 μA, 8 μA, and 10 μA. These different current sources may be activated dependent on the digital code received by DAC control circuit 22. Thus, when the control code provided to DAC control circuit 22 is 00, the current is 4 μA. Similarly, when the control codes are 01, 10, and 11, the currents are 6 μA, 8 μA, and 10 μA, respectively. Effectively, DAC control circuit 22 and the current sources represented in the drawing by P2 form a DAC in which the amount of current I1 (the analog signal produced by the DAC) is dependent on the digital control signals [m−1:0]. For this particular embodiment, m=4, the amount of current I1 can be expressed as:

$$I1=I_ref*(2+Coarse_trim<m-1:0>*1/16).$$

Generally speaking, the DAC formed by DAC control circuit 22, in conjunction with the current sources represented by P2, provides adjustments of the current (I1) passing through variable resistor R1, and thus coarse control of the offset voltage.

Fine control of the offset voltage in the illustrated embodiment is provided via DAC control circuit 24 in conjunction with R1. As shown here, R1 is a variable resistor that is made up of a number of smaller resistors (R11, R12, R13, etc., up to R1Z, where Z is an integer number) selectable (via switches S1, S2, etc.) to provide further adjustment to the offset voltage, V_os. In one embodiment, the resistance value of each of the smaller resistors R11, R12, etc., may be substantially equal, although this is not a requirement for all embodiments. An n-bit digital code (where 'n' is an integer value) is provided to DAC control circuit 24 which causes one of the resistors to be coupled to the non-inverting input of amplifier A1 via a corresponding one of the switches. This in turn determines an amount of voltage dropped between the output of the current sources represented by P2 and the non-inverting input of A1, and thus provides and adjustment to the offset voltage generated across R1. The adjustments to the resistance may be small in one embodiment, with a corresponding fine adjustment to the offset voltage resulting therefrom. The value of R1 for this particular embodiment, n=5, may be expressed as R1=8*R_ref(1+Fine trim<n−1:0>*1/32). DAC control circuit 24 and the resistors of R1 effectively form a DAC which produces a small variation in an analog voltage (the offset voltage) provided to the non-inverting input of A1.

The gain of regulator output in the illustrated embodiment is controlled in part via DAC control circuit 26 (in conjunction with N3), which provide gain trim. For the sake of simplicity, N3 is shown here as a single variable transistor, although in practice it may be implemented as a number of matched current sinks (which themselves may be NMOS transistors). DAC control circuit 26 is coupled to receive an x-bit digital code (where 'x' is an integer value) from the control circuit to cause selection of corresponding ones of the current sinks represented by N3—and thus current I2. Effectively, DAC control circuit 26 in conjunction with the current sinks represented by N3 form a DAC in which the analog signal is the current I2. The current I2 for this particular embodiment, x=7, may be expressed as I2=Iref*(2+(Gain Trim<x−1:0>)*1/128), where the digital code x−1:0 is a 2's complement code.

The resistance of feedback resistor in the embodiment shown is controlled by DAC control circuit 28. In this embodiment, DAC control circuit 28 is coupled to receive a y-bit digital code from the control circuit which in turn controls the amount of resistance provided by (variable) feedback resistor R2. Thus, DAC control circuit 28, in conjunction with feedback resistor R2, forms a DAC in which the analog signal is the feedback signal from V_out to the inverting input of A1.

In this particular embodiment, y=8, the resistance of R2 may be expressed by the following equation: R2=dac_code<y−1:0>*(15*R_ref+15/16*R_ref)/255.

Amplifier A1 in the embodiment shown is arranged to produce an output voltage based on the various parameters controlled by the DACs of voltage regulator circuit 20. Based on the current I2, the resistance of R2, and the offset voltage, the output voltage V_out may be expressed as V_out=V_os+I2*R2. This output voltage is the voltage that is provided to functional circuits coupled to receive a supply voltage from voltage regulator 20.

The design of voltage regulator 20 may be provide a number of advantages. In contrast to various embodiments of a voltage regulator with one or more integrated DACs, various embodiments of the voltage regulator described herein may be implemented without requiring any of the DAC outputs to have a full-rail voltage swing (e.g., between V_supply and ground). Furthermore, the arrangement shown herein enables the offset voltage and the gain to be adjusted independently of one another. With regard to amplifier A1, the amplifier design may be relaxed, designed as an amplifier with a small offset voltage at relatively fixed common mode input. Accordingly, a full rail-to-rail design for amplifier A1 is not necessary, which can reduce the size and complexity of the design.

Figure 3:
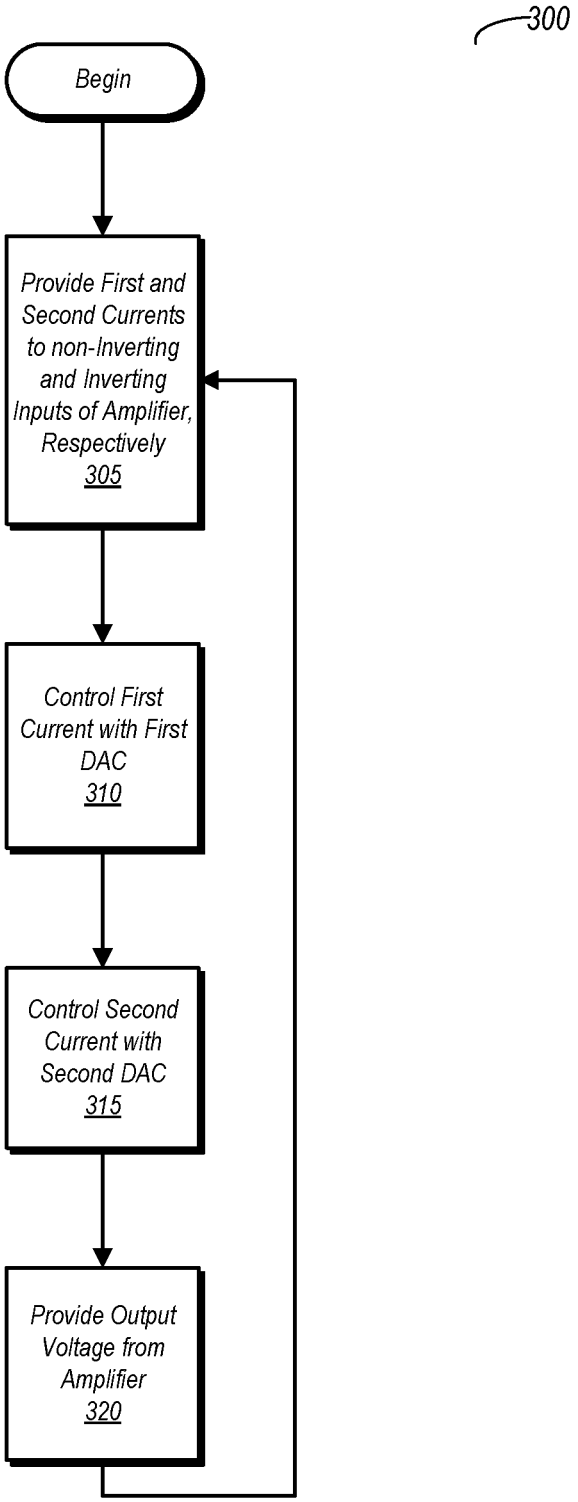
FIG. 3 is a flow diagram illustrating one embodiment of a method for operating a voltage regulator circuit.

FIG. 3 is flow diagram of one embodiment of a method for operating a voltage regulator. Method 300 may be performed with voltage regulator 20 as discussed above and illustrated in FIG. 2. Other embodiments of a voltage regulator capable of performing method 300 are also possible and contemplated. Such embodiments may thus fall within the scope of this disclosure.

Method 300 includes providing first and second currents to non-inverting and inverting inputs of an amplifier, respectively (block 305). The first and second currents may be provided from first and second current mirrors, respectively. Method 300 further includes controlling the first current with a first DAC (block 310). The first DAC may receive a first digital code, which is converted into an analog signal in the form of an amount of current provided from the first current mirror. In one embodiment, control of the current from the first current mirror may be used to control an amount of offset voltage provided to the non-inverting input of the amplifier.

Method 300 further includes controlling the second current with a second DAC (block 315). The second DAC may receive a second digital code, which in turn is converted into a second analog signal in the form of an amount of current as output from the second current mirror. Furthermore, in controlling the current from the second current mirror, the second DAC may be used in controlling the amount of gain provided by the amplifier. Controlling the gain may thus provide at least partial control the output voltage provided by the amplifier (block 320).

In some embodiments, additional DACs may be present. For example, while the first DAC may be used to provide coarse control of the offset voltage, another DAC may be implemented to provide fine control of the offset voltage. The fine control of the offset voltage may be provided by adjusting a resistance of a variable resistor coupled between the non-inverting input of the amplifier and a ground (or reference) node, thereby providing fine control of an analog offset voltage. Another DAC may also be provided to control an amount of resistance provided by a variable feedback resistor coupled between the amplifier output and the inverting input.

Figure 4:
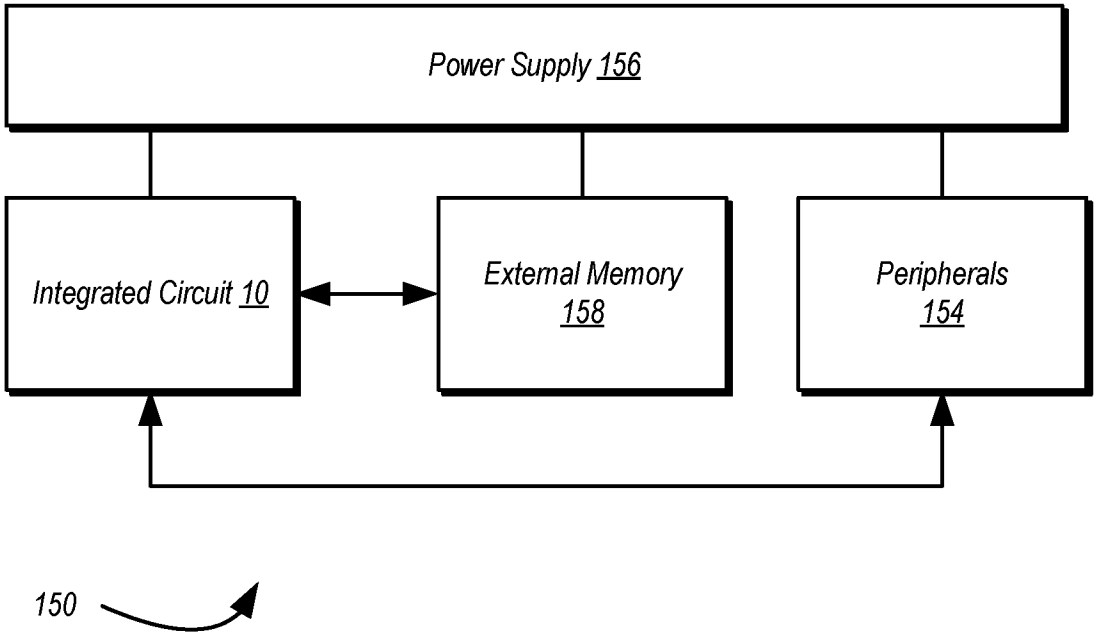
FIG. 4 is a block diagram of one embodiment of an exemplary system.

Turning next to FIG. 4, a block diagram of one embodiment of a system 150 is shown. In the illustrated embodiment, the system 150 includes at least one instance of an integrated circuit 10 coupled to external memory 158. The integrated circuit 10 may include a memory controller that is coupled to the external memory 158. The integrated circuit 10 is coupled to one or more peripherals 154 and the external memory 158. A power supply 156 is also provided which supplies the supply voltages to the integrated circuit 10 as well as one or more supply voltages to the memory 158 and/or the peripherals 154. In some embodiments, more than one instance of the integrated circuit 10 may be included (and more than one external memory 158 may be included as well).

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as WiFi, Bluetooth, cellular, global positioning system, etc. The peripherals 154 may also include additional storage, including RAM storage, solid-state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, tablet, etc.).

The external memory 158 may include any type of memory. For example, the external memory 158 may be SRAM, dynamic RAM (DRAM) such as synchronous DRAM (SDRAM), double data rate (DDR, DDR2, DDR3, LPDDR1, LPDDR2, etc.) SDRAM, RAMBUS DRAM, etc. The external memory 158 may include one or more memory modules to which the memory devices are mounted, such as single inline memory modules (SIMMs), dual inline memory modules (DIMMs), etc.

Numerous variations and modifications will become apparent to those skilled in the art once the above disclosure is fully appreciated. It is intended that the following claims be interpreted to embrace all such variations and modifications.

What is claimed is:

1. A circuit comprising:

a current mirror unit comprising a first current mirror circuit configured to provide a first current, and a second current mirror circuit configured to provide a second current;

an amplifier having an inverting input and a non-inverting input, wherein the first current mirror circuit is coupled to the non-inverting input and the second current mirror circuit is coupled to the inverting input;

a first control circuit configured to control an amount of current provided by the first current mirror circuit;

a second control circuit configured to control an amount of current provided by the second current mirror circuit; and a third control circuit configured to generate a plurality of digital codes and coupled to provide each of the plurality digital codes to a correspondingly coupled one of a plurality of control circuits, the plurality of control circuits including the first control circuit and the second control circuit.

2. The circuit as recited in claim 1, further comprising:

a first variable resistor coupled between the non-inverting input and a reference node; and a second variable resistor coupled between the inverting input and an output of the amplifier.

3. The circuit as recited in claim 2, wherein the first variable resistor is coupled to the first current mirror circuit.

4. The circuit as recited in claim 3, further comprising a fourth control circuit configured to control an amount of resistance provided by the first variable resistor.

5. The circuit as recited in claim 4, wherein the first control circuit is configured to provide a coarse adjustment of an offset voltage and wherein the third control circuit is configured to provide a fine adjustment of the offset voltage.

6. The circuit as recited in claim 2, wherein the second variable resistor is coupled to the second current mirror circuit.

7. The circuit as recited in claim 6, further comprising a fifth control circuit configured to control an amount of resistance provided by the second variable resistor.

8. The circuit as recited in claim 1, wherein the second control circuit is configured to control an amount of gain by the amplifier.

9. The circuit as recited in claim 1, further comprising a reference current source coupled to provide a reference current to the current mirror unit, wherein the reference current is based on a current through a reference resistor coupled to receive a reference voltage.

10. A method comprising a current mirror unit providing a first current from a first current mirror circuit and a second current from a second current mirror circuit, wherein the first current mirror circuit is coupled to a non-inverting input of an amplifier, and wherein the second current mirror circuit is coupled to an inverting input of the amplifier;

a first control circuit controlling the first current, the first control circuit being coupled to the first current mirror circuit;

a second control circuit controlling the second current, the second control circuit being coupled to the second current mirror circuit;

the amplifier providing an output voltage based at least in part on the first current and the second current; and generating an offset voltage across a first variable resistor coupled between the non-inverting input of the amplifier and a reference node, wherein the first control circuit is configured to provide a coarse adjustment of the offset voltage.

11. The method as recited in claim 10, further comprising a third control circuit providing a fine adjustment of the offset voltage by adjusting a resistance provided by the first variable resistor.

12. The method as recited in claim 10, further comprising a fourth control circuit adjusting a resistance of a second variable resistor, the second variable resistor being coupled between the inverting input and an output of the amplifier.

13. The method as recited in claim 10, further comprising the second control circuit adjusting a gain by the amplifier.

14. The method as recited in claim 10, further comprising a reference current source providing a reference current to the current mirror unit.

15. The method as recited in claim 10, further comprising a control circuit generating and providing a plurality of digital codes to correspondingly coupled ones of a plurality of control circuits, the plurality of control circuits including the first control circuit and the second control circuit.

16. A circuit comprising:

a current mirror unit comprising a first current mirror circuit configured to provide a first current, and a second current mirror circuit configured to provide a second current;

an amplifier having an inverting input and a non-inverting input;

a first variable resistor coupled between the non-inverting input and a reference node, wherein the first variable resistor is coupled to the first current mirror circuit;

a second variable resistor coupled between the inverting input and an output of the amplifier and further coupled to the second current mirror circuit;

a first control circuit configured to control an amount of current provided by the first current mirror circuit;

a second control circuit configured to control an amount of current provided by the second current mirror circuit;

a third control circuit configured to control an amount of resistance provided by the first variable resistor; and a fourth control circuit configured to control an amount of resistance provided by the second variable resistor.

17. The circuit as recited in claim 16, wherein the first control circuit is configured to provide a coarse adjustment to an offset voltage provided to the non-inverting input of the amplifier;

the second control circuit is configured to adjust a gain provided by the amplifier; and the third control circuit is configured to provide a fine adjustment to the offset voltage.

18. The circuit as recited in claim 16, further comprising a control circuit configured to generate and provide first, second, third, and fourth digital codes to the first, second, third, and fourth control circuits, respectively.

* * * * *